US006837340B2

(12) United States Patent
Strauss et al.

(10) Patent No.: US 6,837,340 B2
(45) Date of Patent: Jan. 4, 2005

(54) COMPENSATION WEIGHTS AND ELEVATOR SYSTEMS

(75) Inventors: Juergen Strauss, Schattendorf (CH); Thomas Bauer, Schattendorf (CH); Hans Gerhard Dahm, Schattendorf (CH)

(73) Assignee: Datwyler AG, Altdorf (CH)

( * ) Notice: Subject to any disclaimer, the term of this patent is extended or adjusted under 35 U.S.C. 154(b) by 0 days.

(21) Appl. No.: 09/795,749

(22) Filed: Feb. 28, 2001

(65) Prior Publication Data

US 2002/0046908 A1 Apr. 25, 2002

Related U.S. Application Data

(60) Provisional application No. 60/245,498, filed on Nov. 3, 2000.

(30) Foreign Application Priority Data

Oct. 20, 2000 (EP) ..... 00122907

(51) Int. Cl.[7] ..... B66B 7/00
(52) U.S. Cl. ..... 187/413; 187/411; 187/266
(58) Field of Search ..... 187/251, 266, 187/411, 413, 414

(56) References Cited

U.S. PATENT DOCUMENTS

| | | | | | |
|---|---|---|---|---|---|
| 4,445,593 | A | * | 5/1984 | Coleman et al. | 187/411 |
| 4,664,229 | A | | 5/1987 | Obst | 187/411 |
| 4,716,989 | A | | 1/1988 | Coleman et al. | 187/411 |
| 4,724,929 | A | * | 2/1988 | Coleman et al. | 187/413 |
| 4,725,123 | A | * | 2/1988 | Anelli et al. | 385/100 |
| 5,683,773 | A | * | 11/1997 | Kemper | 428/36.91 |
| 6,216,554 | B1 | * | 4/2001 | Kimura et al. | 74/502.5 |
| 6,364,063 | B1 | * | 4/2002 | Aulanko et al. | 187/251 X |

FOREIGN PATENT DOCUMENTS

| | | | | | |
|---|---|---|---|---|---|
| DE | 1544948 | A | * | 12/1969 | |
| EP | 0 100 583 | | | 2/1984 | |
| EP | 179648 | A1 | * | 4/1986 | |
| GB | 2299145 | A | * | 9/1996 | |
| JP | 59-157312 | A | * | 9/1984 | |
| JP | 3-1409 | A | * | 1/1991 | |
| JP | 3-176912 | A | * | 7/1991 | 174/117 F |
| JP | 4-201966 | A | * | 7/1992 | 187/414 |
| JP | 6-44829 | A | * | 2/1994 | 174/117 F |

* cited by examiner

*Primary Examiner*—Eileen D. Lillis
*Assistant Examiner*—Thuy V. Tran
(74) *Attorney, Agent, or Firm*—Marshall, Gerstein & Borun LLP

(57) ABSTRACT

The invention provides a compensation weight for an elevator system, in the form of an extended cable. The compensation weight comprises at least one carrying organ, at least one weighted element, wherein the weighted element contains a mixture of plastic material and at least one of a pulverized metal salt and a pulverized metal chalcogenide with a density about or greater than 2.3 g/cm$^3$, and an extended, flexible sheath. According to another aspect, the invention provides a compensation weight for an elevator system, in the form of a flat cable. It comprises one or more weighted elements, one or more lengthily extended carrying organ, a flexible sheath, and a plurality of hollow spaces encased by said sheath for the reception of the one or more weighted elements and the one or more lengthily extended carrying organ. The at least one carrying organ and at least one weighted element are designed to be separately and respectively in different hollow spaces encased by the sheath. According to still further aspects, the invention is also directed to elevator systems with corresponding compensation weights.

10 Claims, 3 Drawing Sheets

COMPENSATION WEIGHTS AND ELEVATOR SYSTEMS

This application claims the benefit of Provisional Application Ser. No. 60/245,498, filed on Nov. 3, 2000.

FIELD OF THE INVENTION

The present invention concerns the field of elevators, more particularly compensation weights for elevator systems, as well as an elevator system with such compensation weights.

BACKGROUND OF THE INVENTION

An elevator system, generally, encompasses a car, a counterweight for said car, and also at least a carrying cable. This carrying cable is led from the top of the car over a drive and a turn-around pulley. The cable is also affixed to the top of counterweights. The elevator system moreover possesses compensation weights to balance the weight of the above carrying cable and which compensation weights are fastened to the underside of the car and hang down therefrom in loops. Under certain circumstances, the compensation weights are led to a guide roll in the shaft bottom and their other ends are secured on the underside of said counterweights. In these ways, the pulling force exerted by the said drive is compensated for in any position of the car. The only variable remaining is the weight of the load to be transported, which must be overcome by the said drive.

In the case of elevator speeds of more than 3.5 m/s, the compensation weight, for the great part, is of steel cable. Upon lifting at lesser speeds, a compensation weight can be in the form of a round or flat weighted cable, i.e., a plastic cable, which encapsulates one or more carrying organs and, if required, one or more additional weighted elements.

The compensation weights predominately used at the present time are round weighted cables, which is to say, which possess a chain-like lift organ of steel in a sheath of plastic.

EP-B-0 100 583 proposes a compensation weight in cable form, which exhibits at least one lift organ in the form of a chain or wire rope. Again, the said organ will be enclosed within a sheath, the volume of which, in at least one embodiment, shows a mix of metal particles and plastic material.

In another embodiment, in the form of a flat shaped cable, the lifting organs are installed within hollow spaces, which includes, besides the stated lifting organs, also a mixture of plastic material and metal particles. Hollow spaces, which only contain plastic material and metal particulate are not described.

The lifting cable described in EP-B 0 100 583 shows, in comparison to conventional weighted cables, a higher weight per unit of length, or, for the given weight per unit of length, lesser outer dimensioning.

However, the manufacture of that kind of weighted cable is not without problems. In order to introduce the metal particulate into the plastic, which is to encapsulate them, recourse must be made to special, complex and expensive additional mechanisms and/or additional fabrication means, which, normally, are not employed in the cable industry.

Thus, in view of the above, the purpose of the invention is to create a compensation weight, which can be fabricated simply and with the conventional processing equipment of the cable industry.

SUMMARY OF THE INVENTION

The invention provides a compensation weight for an elevator system, in the form of extended cable. The compensation weight comprises at least one carrying organ, at least one weighted element, wherein the weighted element contains a mixture of plastic material and at least one of a pulverized metal salt and a metal chalcogenide with a density of about or greater than 2.3 g/cm3, and a lengthily extended, flexible sheath.

According to another aspect, the invention provides a compensation weight for an elevator system, in the form of extended flat cable. It comprises one or more weighted elements, one or more lengthily extended carrying organ, a lengthily extended, flexible sheath, and a plurality of hollow spaces encased by said sheath for the reception of the one or more weighted elements and the one or more lengthily extended carrying organ. The at least one carrying organ and at least one weighted element are designed to be separately and respectively in different hollow spaces.

According to still further aspects, the invention is also directed the elevator systems with corresponding compensating weights.

Other features are inherent in the disclosed system or will become apparent to those skilled in the art from the following detailed description of embodiments and its accompanying drawings.

DESCRIPTION OF THE PREFERRED EMBODIMENTS

Figure 1:
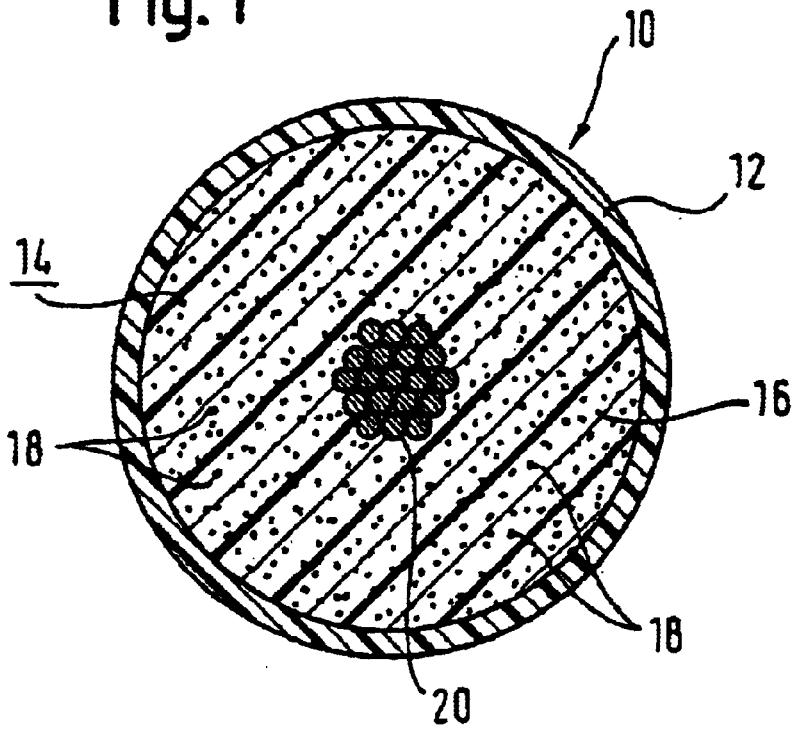
FIG. 1 a schematic cross-section through a compensation weight in the form of a round cable, FIG. 2 a schematic cross-section through another compensation weight in the form of a round cable, FIG. 3 a cross-section through a compensation weight formed as a flat cable, FIG. 4 across-section through another embodiment of a compensation weight with integral electrical components, said compensation weight being in the form of a flat cable, FIG. 5 a perspective view of a compensation weight, wherein the carrying organ is exposed for fastening, FIG. 6 a half-transparent perspective view, made so on the grounds of visibility, indicating the partial removal or unwinding of an alternative weighted element, and FIG. 7 a schematic presentation of an elevator system.

FIG. 1 shows a schematic outline of a cross-section of a first embodiment of a compensation weight. Before proceeding further with the description, however, a few items of the preferred embodiments will be discussed.

The carrying organ is that particular part of the compensation weight, which carries the latter between the car and the counterweight. The weighted organ thereof has no carrying function, but serves principally for adding mass to the compensation weight.

The preferred embodiments relating to the first aspect of the invention provide a compensation weight, which possesses a carrying organ. The carrying organ is normally a chain, or preferentially, a wire rope with a flexible sheath, that sheath being normally of plastic, and at least one weighted element. The weighted element contains a mixture of plastic material and one or more pulverized salts of metals and/or metal chalcogenides (particularly oxides and sulfides) which should exhibit a mass density of about or greater than 2.3 g/cm$^3$. The weighted element can directly envelope the carrying organ, or be employed entirely separately.

The metal salt and/or metal chalcogenide, which is used for the weighted element of the preferred embodiments of the first aspect exhibits specific densities of about or greater than 2.3 g/cm$^3$ with preferred specific densities being about or greater than 3.0 g/cm$^3$, 4.0 g/cm$^3$ and 4.2 g/cm$^3$. These immediately foregoing materials may, before the eventual extrusion of a composite mass, be mixed simply in a fluid mixer or double screw kneader with the plastic (optionally together with mixing in plastic additives). Thus, for example, in the case of the use of a soft-PVC as the plastic for the weighted element, the mixing operation would be carried out in one step with the treatment of PVC with a softener, a dry filler—such as chalk—a stabilizer and including the above defined metal salt and/or metal chalcogenide and mixtures thereof. This method is hardly possible in the conventional state of the technology, with metal particulate, since the mixing apparatus would be damaged thereby. Metal particulate, as well as metal powders, universally exhibit, in comparison to metal salts and metal chalcogenides, definite disadvantages, among these being abrasion, higher purchase costs, and a more expensive work-up in process. The metal particulate of the prior state of the technology must be dosed to the plastic in a separate step, which increases the complexity of the process. Further, the relatively large metal particles, of the said state of the technology, lead to a grabbing or pinching of the extruder screw during the extrusion about the carrying organ.

The preferred embodiments relating to the second aspect of the invention provide a compensation weight in which at least one carrying organ (preferentially, all), and at least one weighted element (preferentially all) are placed separately in different hollow spaces of the compensation weight in the form of a flat cable, which is resistant to transverse twisting. This or those weight element(s) may be the same as those mentioned above or different ones.

The separated state of the carrying organs and the weighted element enables a more flexible weight adjustment for the compensation weight. Thus, by standard dimensioning and numbering of existing carrying organs, such as a steel rope, a weight adjustment can be advantageously varied by the number and size of the weighted elements.

In consideration of the apparatuses which are employed in the cable industry, the processing is simpler, to manufacture the weighted elements separate from the carrying organs by means of extrusion, than it is to extrude each single weighted element required for the current application, and subsequently, then extrude a sheath about this intermediate product, as is the case in the state of the technology. Standardized, half-fabricated units of weighted elements can be manufactured and stored in a rational manner. The manufacture of different end-products of different weight classes is thus possible on a short time basis. This can be done in small lot sizes which is also economically advantageous.

Otherwise, by means of tandem or co-extrusion, the manufacture of the weighted elements can be combined with sheath extrusion. Several weighted elements can then be fabricated as a single block (sandwich fabrication). This is advantageous, when especially large quantities of a special compensation weight must be manufactured.

A separate inventory of carrying organs and weighted elements is also of value in the hanging of the compensation weights. For the installation of the carrying organs at the car and also on the compensation weight, the encasing plastic has to be removed only from the carrying organs (mostly two thereof, which, respectively, are placed on each side of the flat cable). Those parts, which hold only the weight organs simply can be cut off. Further, the use of conventional cable hanging techniques on the car and the counterweight remain possible, and the manipulation of the flat cable, which is similar to flat electrical cable, is a well known procedure for the installation crews.

Since each of the two aspects of the invention is independently advantageous, there are preferred embodiments in which only the first aspect or only the second aspect is realized. However, from the point of view of economics, most preferred are embodiments which realize both aspects, since, for example, only two expensive carrying organs are needed and the remainder of required weight can be made available by a more economical plastics/metal salt and/or a chalcogenide mixture.

In the preferred embodiments, the carrying organs can include wire ropes or chains, wherein, the preference is given to wire rope. The thickness of the wire rope or the chains is to meet the individual requirements of the compensation weight. Where steel wire rope is concerned, the thickness can range from about 3 mm to about 10 mm. The material of the carrying organ is preferentially selected from steel, iron, polyamides, aramides, or carbon fiber. Of particular advantage is to make the carrying organ a steel rope, since this is heavy and at the same time, in regard to the hanging operation, is easily separated from the encompassing plastic sheath (by cutting and pulling).

In a preferred embodiment in the form of a flat cable, preferably, two carrying organs lie respectively neighboring the cross-section ends, which are curved, that is, the said two carrying organs are respectively proximal to the two extreme ends of the of the flat cable cross-section. The weighted element(s) lie in this configuration preferably in a plane between the carrying organs. In case of need, however, there can be more than two carrying organs, e.g., still another carrier present in the middle of the cable.

The flexible sheath of the compensation weight of the present invention comprises any plastic sheath as is common in the cable industry, which, preferably, can be heavily laden with filling materials. Non-limiting examples thereof are, for instance, soft PVC, thermoplastic elastomers, polyolefin rubber, including ethylene-octane-copolymers and polyisobutylene, butyl rubber, ethylene-propylene-diene terpolymers, chloro-sulfonated polyethylene, vulcanized chloroprene, fluid polymers in combination with thermoplastics, polyamides, polyurethanes, silicon rubber and mixtures thereof. The choice directs itself to the requirements of the current application. Soft PVC is preferred because of its price and its good workability with a high content of filler (such as metal salts or metal chalcogenides—see below). One can still desire, to choose a non-chlorinated plastic. All of these plastics can be provided with customary additives.

In some of the preferred embodiments, the sheath can be caused to contain, for additional weight increase, likewise one or more metal salts and or metal chalcogenides with a mass density of about or greater than 2.3 g/cm$^3$. These are not applied in too great quantities, however, so as not to undermine the mechanical characteristics of the sheath. An advantageous range for metal salts and/or metal chalcogenides would be from about 20 wt % to 40 wt %, preferably from about 20 wt % to about 30 wt %, relative to the total weight of the sheath. In this way, therefore, a sheath compounding could comprise:

from about 20 wt % to about 30 wt % PVC, from about 15 wt % to about 25 wt % PVC softener, from about 20 wt % to about 30 wt % dry filler, such as chalk and from about 20 wt % to about 30 wt % metal salts/metal chalcogenides having a density of about or greater than 2.3 g/cm$^3$, as well as a total of about 2 wt % stabilizer, lubricant and other workability enhancers and, if required, fire prevention additives. All percentages, as noted, were in relation to the total weight of the sheath. The sheath can be profiled on the surface for better manipulation.

The cross-sectional dimensioning of the weighted elements, as is the case with the carrying organ, is adapted to the individual requirements of the compensation weight. For instance, circular weighted elements utilizing barium sulfate as the material salt, with a mass density of about or greater than 2.3 g/cm$^3$ with a diameter ranging from about 5 mm to about 15 mm.

The pulverized metal salt and/or metal chalcogenide of the weighted element is preferably chosen from:

barium sulfate, natural heavy spar (barite) density range: from about 4.25 g/cm$^3$ to about 4.5 g/cm$^3$ salts and/or chalcogenides containing calcium, iron, copper, or lead such as, for instance, calcium sulfate (gypsum or anhydrite)

density range: from about 2.3 g/cm$^3$ to about 3.0 g/cm$^3$ hematite ($Fe_2O_3$)

density range: from about 5.5 g/cm$^3$ to about 6.5 g/cm$^3$ copper pyrites (chalcopyrite) (CuFeS2)

density range: from about 4.1 g/cm$^3$ to about 4.3 g/cm$^3$ cupric oxide density range: from about 6.3 g/cm$^3$ to about 6.4 g/cm$^3$ lead sulfate density range: from about 6.3 g/cm$^3$ to about 6.4 g/cm$^3$ In addition to the above, slags from blast furnaces may be chosen. Because of its low toxicity and good workability, barium sulfate is particularly advantageous. The powder form of the metal salts and/or metal chalcogenides (average particle diameter preferably from about 5 $\mu$m to about 50 $\mu$m, particularly about 10 $\mu$m) assures that these can be mixed well and uniformly into a plastic medium and that the mixture of plastic and powder also extrudes well. The content of powder material in the mixture of plastic material, metal salt and/or metal chalcogenide, for the provision of an advantageous weight, is high, preferentially ranging from about 50 wt % to about 90 wt %, more preferably 70 wt % to about 90 wt % and especially ranging from about 80 wt % to about 90 wt %, referring to the entire weight of the weighted element.

The plastic material of the weighted element(s) can, similar to the plastic in the sheath, be any conventional one in the cable industry, which has the ability to be very highly laden with filler. In this matter we refer to all the plastics named for the sheath and additional thermoplastics with medium or low Mooney viscosities. These plastics may contain all usual additives.

The mixture of plastic/metal salt and/or metal chalcogenide, following an extrusion forming the weighted element, because of the high filler load, is frequently friable and can tend toward allowing fissure formation, especially where frequent, dynamic bending demands are exacted. This, however, presents no problem, since the weighted element is not involved in the tension of carrying the compensation weight and said fissuring takes place in the enclosed interior of the compensation weight.

A typical weighted element can comprise:

from about 10 wt % to about 20 wt % plastic material, such as butyl rubber about 0.8 wt % softener and lubricating agent, and from about 80 wt % to about 90 wt % metal salt and/or metal chalcogenide (i.e. BaSO4)

The weighted elements can be of any shape, such as cornered, oval, or round. The preferred shape is round.

Further, in some embodiments, the weighted elements exhibit in their middle zone, an auxiliary carrier of wire or a thin, high tensile strength, plastic thread, for instance, of aramide. This auxiliary carrier serves principally to enable an easier extrusion on the available equipment found in the cable industry.

In an additional embodiment, at least one weighted element possesses in its center an electrical line, which can serve for the monitoring of the compensation weight. Beyond this, in a compensation weight, an entire bundle of wires may be enclosed, which can serve for the input and control of various components.

In a special embodiment, there are used in a weighted element, metal cuttings, preferably steel cuttings, with a length ranging from about 0.5 cm to about 6 cm. These cuttings are made stable in shape either by being encased by extrusion or by wrapping in with films or bands. The metal raw material is available as so-called semi-finished rod or wire form. The individual weighted elements are manufactured in a continuous work-process, in which the semi-finished items are cut by high frequency or sawed and encased in plastic by extrusion or wrapping. The so produced weighted elements can be wrapped on rollers and later reworked by renewed extrusion to form the flat cable type of compensation weight. When this occurs one or more of the weighted elements run parallel and together with the carrying organ(s) in the extrusion line for the final sheath process.

Returning now to FIG. 1, it shows in schematic outline a cross-section of a compensation weight 10 in the form of a circular, round cable, which in the middle exhibits carrying organ 20 in the form of a steel rope. This is surrounded by a weighted element 14, which is composed of a mixture of plastic material 16 and metal salt and/or metal chalcogenide 18. A plastic flexible sheath 12 envelopes the compensation weight 10.

Figure 2:
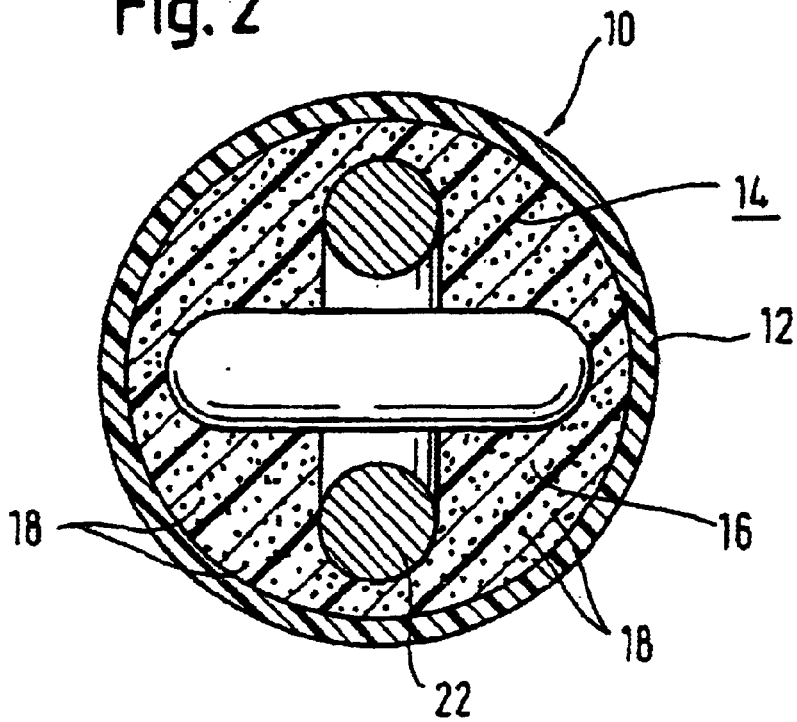

FIG. 2 shows a cross-sectional view of a compensation weight 10, similar to that of FIG. 1, in which, however, the steel rope carrying organ is supplanted by a chain-like carrying organ 22.

Figure 3:
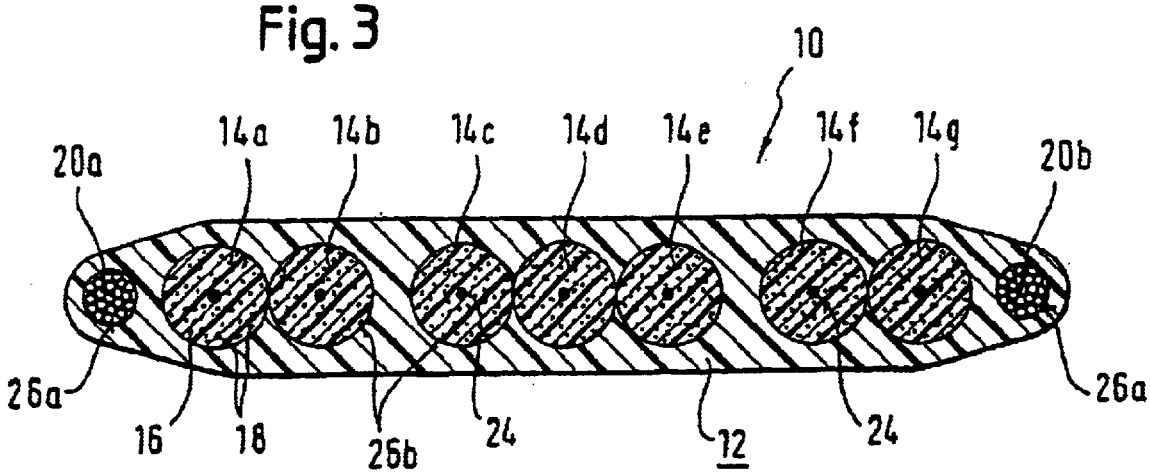

FIG. 3 presents a cross section through a compensation weight 10 in the form of a flat cable. Two outside empty spaces 26*a* contain two carrying organs 20*a*, 20*b* in the form of steel wire ropes. Between these, lay seven hollow spaces 26*b* containing seven weighted elements 14*a–g*, which comprise a mix of plastic material 16 and metal salt and/or metal chalcogenide 18 and as well as an auxiliary carrier 24 of wire or a tear resistant plastic. The flexible sheath 12 is made of plastic 16. In total, nine hollow spaces, 26*a*, 26*b* lie in a straight line along the cross-sectional middle axis of the flat cable.

The diameter of the outer hollow spaces 26*a* is smaller than the diameter of the inner hollow spaces 26*b*. This leads to a cross sectional shape of the flat cable of a kind of rectangle with extremities which diminish in width outwardly at the two narrowing ends. A compensation weight 10 of this kind can exhibit e.g. a weight of 1.5 kg/m to 6.0 kg/m, especially when its outer sheath 16 contains likewise metal salt and/or metal chalcogenide 19 (as shown in FIG. 4).

Figure 4:
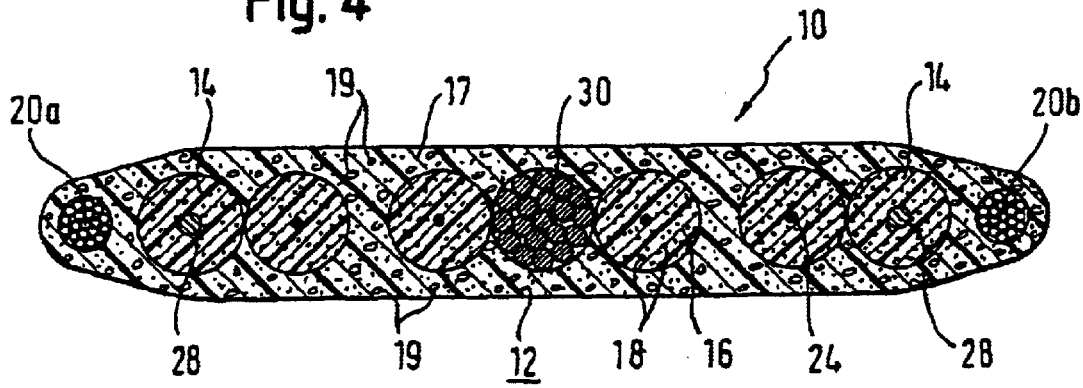

FIG. 4 demonstrates a cross-section through another embodiment of a compensation weight 10 in the form of a flat cable. This embodiment differs from that of FIG. 3, in that here also the sheath (besides plastic 17) contains metal salt and/or metal chalcogenide 19, that the weight organs 14 possess an electrical wire 28 instead of the auxiliary carrier 24 and that further one of the weighted elements 14 (here the central one) is replaced by an electrical wire bundle 30, which is also encapsulated in the flexible sheath 12.

Figure 5:
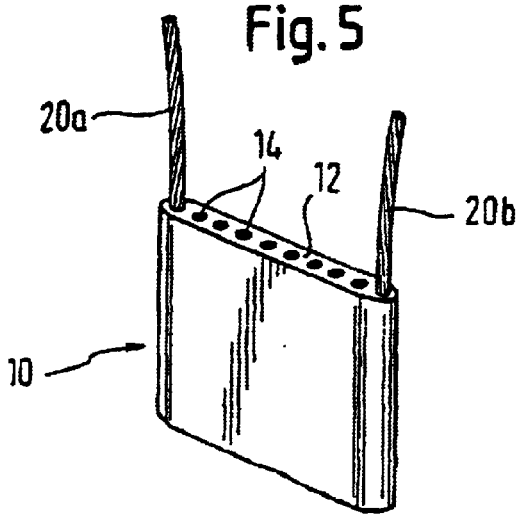

FIG. 5 shows a compensation weight 10, following the type of the flat cable of FIG. 3, in which, for site installation, one end of the carrying organs (steel wire ropes) 20*a*, 20*b* has been freed. The portion of the flexible sheath 12 and the weighted elements 14 which lay between, were simply cut off.

Figure 6:
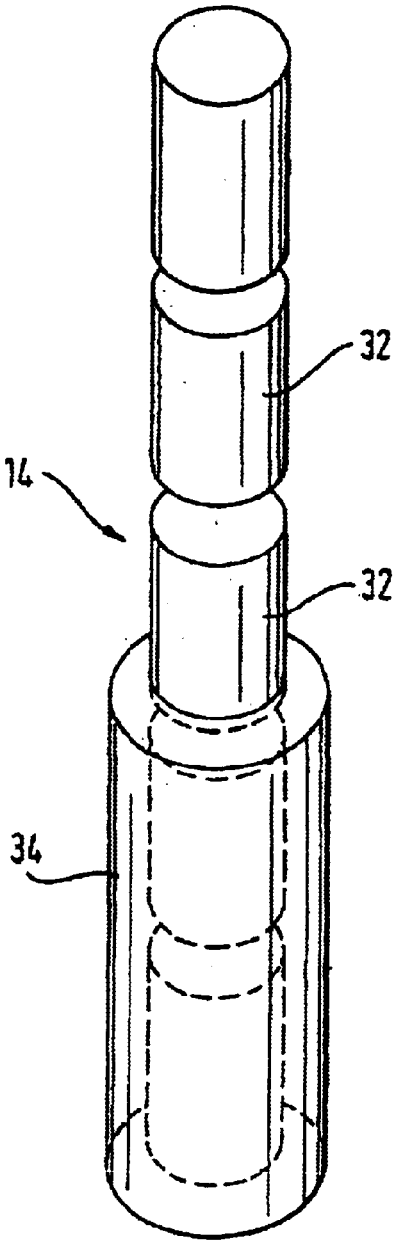

FIG. 6 shows an alternative embodiment of a weighted element 14. This is not built of a plastic-powder compound, as is the case of the weighted elements in FIGS. 1 to 5. Rather it is formed by discrete weight members, especially of metal, and here constructed by cut or sawed, linearly ordered, steel wire or steel rod sections 32 and preferably enclosed in a winding or wrapping 34 to achieve shape stability. These weighted elements built up by pieces can, in the embodiments of FIGS. 1 to 5, substitute in the place of the compounded weighted elements. In the case of embodiments with several weighted elements (for instance, FIGS. 3 to 5), hybrids are also possible, which would include at least one weighted element from each of the two kinds.

Figure 7:
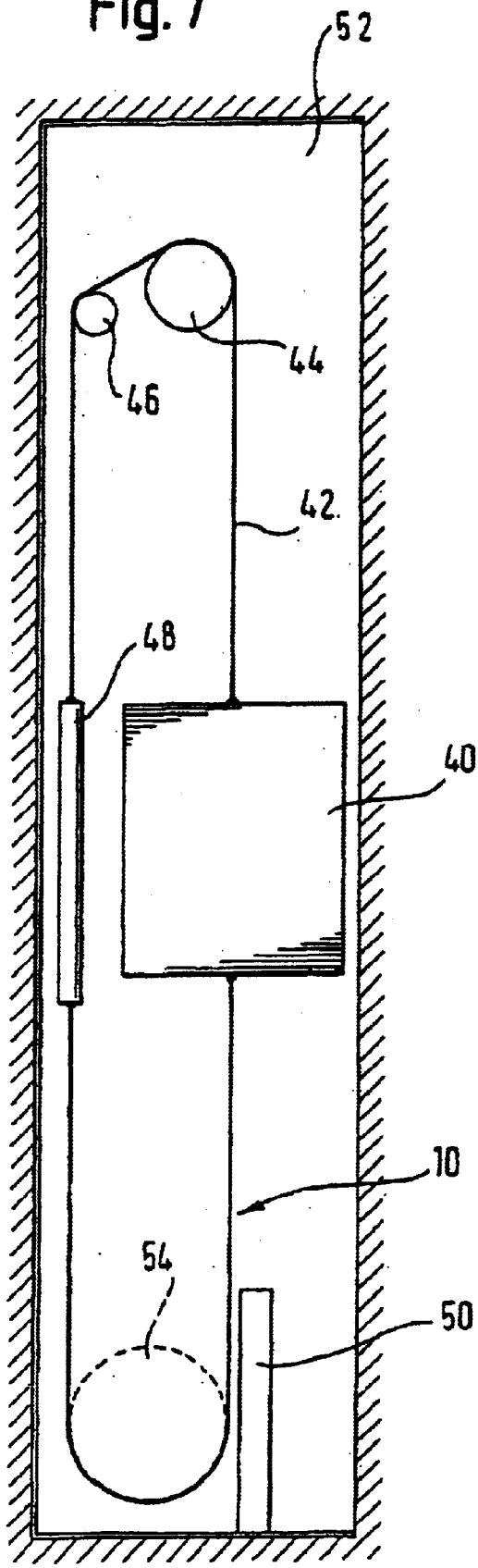

FIG. 7 shows an elevator system in an elevator shaft 52 with a bottom located buffer 50. The system is equipped with a compensation weight 10, which is fastened to the bottom of a car 40 and extends itself from there to the under-end of a counterweight 48 running beside the car 40, to which it is also fastened. For increasing the quiet and smoothness of the running, especially when the elevator system is beset with wind, the compensation weight 10 can be run about an optional guide roll 54 (shown in dotted line), or it can hang free in a loop in the elevator shaft. A carrying cable 42 is run from the top of the car 40 over a drive roll 44 and then over a turn-around roll 46 to the upper end of the car counterweight 48 and is secured to the upper end thereof and to the car 40. As a rule, the compensation weight 10 should essentially match the same length as that of the carrying cable 42, (whereby eventual windings or horizontal guiding of the carrying cable 42 to and about the drive 44 or the turn-around roll 46, are not considered). From the standpoint of safety, 5 or more carrier cables 42 can be furnished. A single compensation weight 10 or several parallel arranged compensation weights 10 can be provided. The weight per unit length of the compensation weight 10 should advantageously be chosen equal to the weight per unit length of the carrying cable 42, regardless of the number of cables or compensation weights. The designed adjustment of the weight can be determined by means of an appropriate choice of the weight materials, the cross-sections thereof and/or the number of the weighted elements. With such an arrangement, the situation can be achieved, wherein the load acting on the drive 44, is independent of the position of the car 40. Then, by appropriate choice of the weight of the counterweight 48 the drive 44 can be constructively adjusted, advantageously, at a zero or average loadings of car 40, which accrue from transported persons or objects. Then while operating, the drive 44 needs to lift nothing more than the said loading of the car or deviation from the average thereof.

Thus, a general purpose of the disclosed embodiments is to provide an improved compensation weight, which can be fabricated simply and with the conventional processing equipment of the cable industry.

All publications and existing systems mentioned in this specification are herein incorporated by reference.

Although certain systems, methods and products constructed in accordance with the teachings of the invention have been described herein, the scope of coverage of this patent is not limited thereto. On the contrary, this patent covers all embodiments of the teachings of the invention fairly falling within the scope of the appended claims either literally or under the doctrine of equivalents.

What is claimed is:

1. A compensation weight for an elevator system comprising:

one or more weighted elements, one or more lengthily extended carrying organs, an extended cable comprising flexible sheath, the cable defining a plurality of distinct and separate hollow spaces encased by said sheath, each hollow space for the reception of one of the one or more extended weighted elements or one of the one or more lengthily extended carrying organs, wherein the at least one carrying organ and at least one weighted element are segregated from one another and separately received in different hollow spaces of the cable, wherein each of the one or more weighted elements comprises a mixture of plastic material and at least one of a pulverized metal salt and a metal chalcogenide with a density greater than or equal to 2.3 g/cm$^3$.

2. The compensation weight of claim 1, wherein the at least one carrying organ is comprised of materials selected from the group consisting of steel, iron, polyamides, aramides and carbon fibers.

3. The compensation weight of claim 1, wherein the at least one carrying organ is a steel rope.

4. The compensation weight of claim 1, said cable comprises two opposing ends, each end having a curved end cross-section, the compensation weight comprising two carrying organs, one carrying organ being arranged proximal to one of the curved end cross-section, the other carrying organ being proximal to the other curved end cross-section, and the weighted elements are separately disposed in the distinct and separate hollow spaces of the cable and between said two carrying organs.

5. The compensation weight of claim 1, wherein the sheath comprises a plastic, selected from the group consisting of soft PVC, thermoplastic elastomers, polyolefin rubber, including ethylene-octane-copolymers and polyisobutylene, butyl rubber, ethylene-propylene-diene terpolymers, chloro-sulfonated polyethylene, vulcanized chloroprene, fluid polymers in combination with thermoplastics, polyamides, polyurethanes, and silicon rubber.

6. The compensation weight of claim 1, wherein the at least one of the pulverized metal salt and pulverized metal chalcogenide is a powder and is selected from the group consisting of barium sulfate, salts containing calcium, iron, copper, lead, chalcogenides containing calcium, iron, copper, lead, slag from blast furnaces and mixtures thereof.

7. The compensation weight of claim 1, wherein the plastic material of the one or more weighted elements is selected from the group consisting of soft PVC, thermoplastic elastomers, polyolefin rubber, including ethylene-octane copolymers and polyisobutylene, butyl rubber, ethylene-propylene-diene terpolymers, chloro-sulfonated polyethylene, vulcanized chloroprene, fluid polymers in combination with thermoplastics, polyamides, polyurethanes, silicon rubber, thermoplastic materials with low or medium Mooney viscosities and mixtures thereof.

8. The compensation weight of claim 1 wherein the weighted elements comprise a thin auxiliary carrier comprising wire or plastic threads with a high tensile strength.

9. An elevator system comprising:

a car;

a carrying cable, which is guided over a drive and a turn-around roll and is connected to a counterweight; and a compensation weight comprising:

at least one carrying organ;

at least one weighted element, wherein the weighted element contains a mixture of plastic material and at least one of a pulverized metal salt and a metal chalcogenide with a density of greater than 2.3 g/cm$^3$; and a flexible sheath comprising a plurality of separated hollow spaces, each space receiving one weighted element or one carrying organ so that the at least one weighted element is segrated from the at least one carrying organd and disposed in a different hollow space than the at least one carrying organ.

10. An elevator system comprising:

a car, a carrying cable, which is guided over a drive and a turn-around roll and is connected to a counterweight, a compensation weight comprising:

a flat cable, one or more weighted elements, one or more carrying organs, the flat cable comprising a flexible sheath, the flat cable defining a plurality of distinct and separate hollow spaces for receiving one or more weighted elements or the one or more carrying organs, wherein the one or more carrying organs and the one or more weighted elements are segregated from one another by being received in different distinct and separate hollow spaces.

* * * * *

UNITED STATES PATENT AND TRADEMARK OFFICE

CERTIFICATE OF CORRECTION

PATENT NO. : 6,837,340 B2
DATED : January 4, 2005
INVENTOR(S) : Juergen Strauss et al.

It is certified that error appears in the above-identified patent and that said Letters Patent is hereby corrected as shown below:

Column 10,
Line 2, after "carrying" please delete "organd" and insert -- organ -- in its place.

Signed and Sealed this

Fourteenth Day of June, 2005

JON W. DUDAS
*Director of the United States Patent and Trademark Office*